United States Patent [19]

Albright et al.

[11] Patent Number: 4,966,422

[45] Date of Patent: Oct. 30, 1990

[54] DESK AND FILE DRAWER LOCK

[76] Inventors: Russell E. Albright, 28852 Modjeska Canyon Rd., Orange, Calif. 92667; Kenneth G. Green, 304 Sweeturter St., Anaheim, Calif. 92807

[21] Appl. No.: 261,491

[22] Filed: Oct. 24, 1988

[51] Int. Cl.[5] ..... E05B 53/00

[52] U.S. Cl. ..... 312/218; 312/217; 292/159; 292/161

[58] Field of Search ..... 312/218, 216, 217, 219, 312/220, 221, 107.5; 292/175, 153, DIG. 47, DIG. 18, 159, 161; 49/176; 70/85

[56] References Cited

U.S. PATENT DOCUMENTS

| | | | |
|---|---|---|---|
| 1,019,216 | 3/1912 | Bassick | 292/175 |
| 1,595,117 | 8/1926 | Norman | 312/221 |
| 2,992,056 | 7/1961 | Thielker | 312/221 |
| 3,223,466 | 12/1965 | Roberts | 312/220 |
| 3,404,929 | 10/1968 | Wright et al. | 312/216 |
| 4,400,026 | 8/1983 | Brown, Jr. | 292/175 |
| 4,475,311 | 10/1984 | Gibson | 49/176 |

*Primary Examiner*—Peter R. Brown
*Assistant Examiner*—Brian K. Green
*Attorney, Agent, or Firm*—Plante, Strauss, Vanderburgh & Connors

[57] ABSTRACT

There is disclosed a latch mechanism for locking the drawers of items of furniture such as desks and file cabinets. The latch mechanism is manufactured of plastics using injection molding techniques. The mechanism includes an open sided housing having a oppositely directed pair of mounting flanges which extend from the opposite sides of the housing. A longitudinal slot is formed between the flange members and this slot slidably receives the latch member. The cavity of the housing receives a compression spring which protrudes from the open side of the cavity and is received in an aligned slot or through aperture of the latch member. The latch member has a forward and inclined ramp that is mounted opposite and adjacent to the upper cam post of a vertical slide member. The vertical slide member is received in a groove in a upright standard of the furniture, typically in a partition located between the center drawer and a vertically stacked set of lateral drawers of a desk. The slide has a plurality of dependent posts which are positioned adjacent stop members that are placed on each of the drawers.

9 Claims, 3 Drawing Sheets

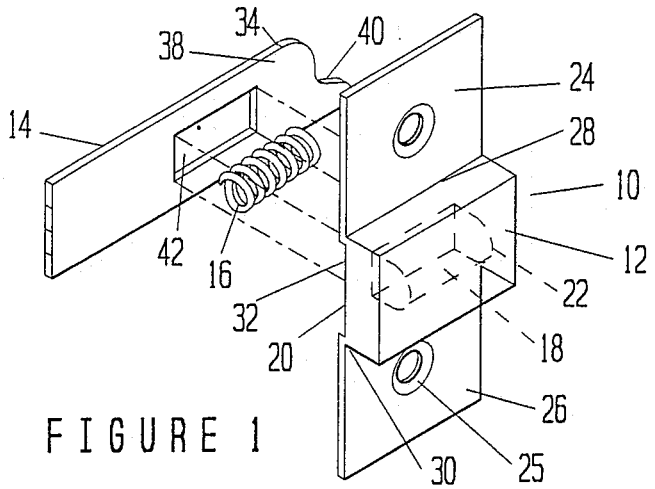
FIGURE 1
FIGURE 2
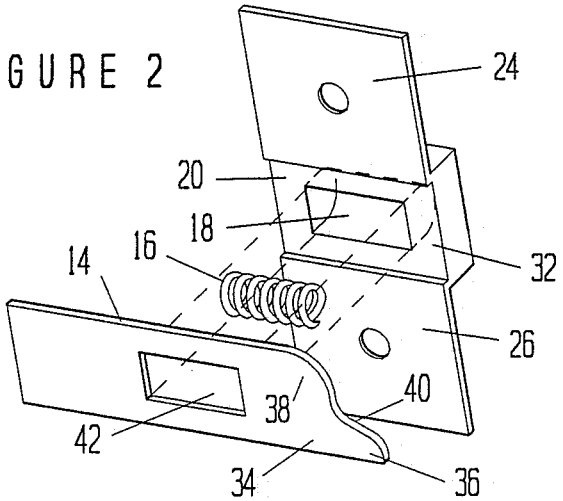

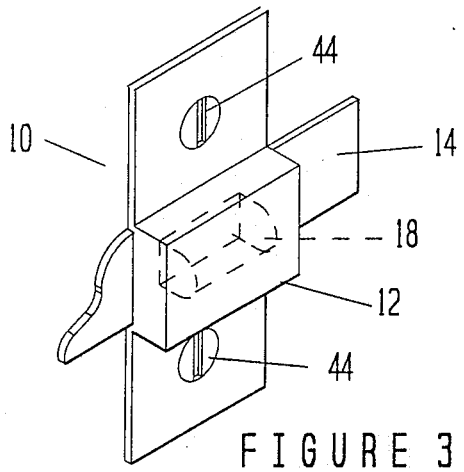
FIGURE 3
FIGURE 4
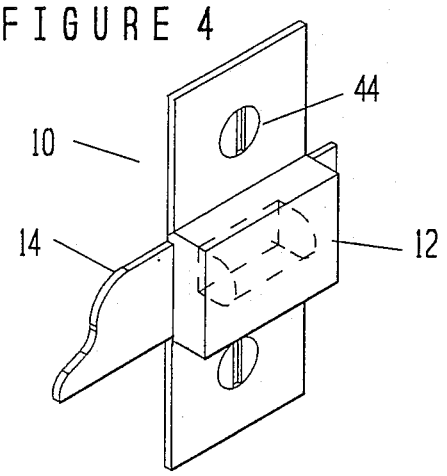

DESK AND FILE DRAWER LOCK

BACKGROUND OF INVENTION

1. Field of the Invention

This invention relates to a latch mechanism for an item of furniture such as a desk or file having multiple drawers.

2. Brief Statement of the Prior Art

Desk and cabinet files with multiple drawers are frequently provided with a locking mechanism in which a multiplicity of drawers are locked from a single location. Commonly, a master latch mechanism is installed on a single drawer such as a top center drawer of a desk or the upper drawer of a file cabinet. The furniture is provided with a vertical slide member that is actuated by the master lock mechanism and that has a lock member which is raised into a locking position for each of the remaining drawers of the cabinet.

One of the difficulties encountered with the conventional lock mechanisms is their complexity and relatively high cost of fabrication and installation. Additionally, the mechanisms are frequently difficult to service and replace.

BRIEF STATEMENT OF THE INVENTION

This invention comprises a latch mechanism for locking the drawers of items of furniture such as desks and file cabinets. The latch mechanism is manufactured of plastics using injection molding techniques. The mechanism includes an open sided housing having a oppositely directed pair of mounting flanges which extend from the opposite sides of the housing. A longitudinal slot is formed between the flange members and this slot slidably receives the latch member. The cavity of the housing receives a compression spring which protrudes from the open side of the cavity and is received in an aligned slot or through aperture of the latch member. This provides the latch member with a resilient sliding engagement in the housing. The latch member has a forward and inclined ramp that is mounted opposite and adjacent to the upper cam post of a vertical slide member. The vertical slide member is received in a groove in a upright standard of the furniture, typically in a partition located between the center drawer and a vertically stacked set of lateral drawers of a desk. The slide has a plurality of dependent posts which are positioned adjacent stop members that are placed on each of the drawers.

BRIEF DESCRIPTION OF THE DRAWINGS

The invention will be described with reference to the figures of which;

FIG. 1 is an exploded perspective view of the latch mechanism;

FIG. 2 is an exploded perspective view showing the opposite the latch mechanism of FIG. 1;

FIG. 3 shows the latch mechanism in its assembled condition;

FIG. 4 illustrates the latch mechanism with the latch member against the compression of its internal spring;

DESCRIPTION OF PREFERRED EMBODIMENTS

Figure 5:
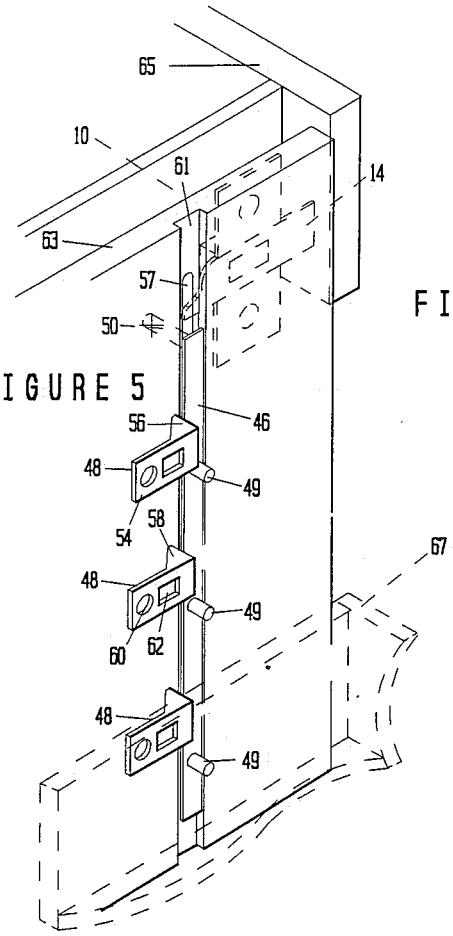
FIG. 5 illustrates the operating positions of the latch, including the latch mechanism, slide member and stop members of the invention.

Referring now to FIGS. 1 and 2, the latch mechanism 10 of the invention includes a housing member 12 and a latch member 14 with a compression coil spring 16. The housing member 12 comprises a generally rectangular shaped housing having a central spring cavity 18 which is molded into one side 20 thereof. The spring cavity 18 can have an arcuately concave bottom surface 22 and is entirely open on the side 20 of the housing. A pair of laterally disposed flanges 24 and 26 are integral with the housing member 12 and extend from the longitudinal edges 28 and 30 along side 20 of the housing. These flanges are not continuous but are separated by a single, longitudinal slot 32 which is co-extensive the length of the housing.

The latch member 14 is an elongated planer member having a forward end 34 with an inclined ramp or cam surface 36. Preferably, the cam surface 36 is arcuate at its most forward end and at an intermediate location 38 with an inclined ramp 40, at an angle from about 10 to 30 degrees, therebetween. The latch member 14 has a single rectangularly shaped aperture 42 which has the same length and width dimensions as the central cavity 18 of the housing. The latch member 14 is slidably received in the single longitudinal slot 32 of the housing member 12 and a compression coil spring 16 is received in the central spring cavity 18. The spring cavity is sufficiently shallow that the spring 16 protrudes along the length of the cavity and is thereby also received in the single rectangularly shaped aperture 42 of the latch member 14 when these members are assembled.

Referring now to FIG. 3, the latch mechanism 10 is shown in its assembled condition. In this illustration, the latch mechanism is installed against a planer surface, typically the inside surface of a partition between a set of laterally positioned drawers and a master or control drawer such as the central drawer of a desk or top drawer of the file cabinet. For this purpose, a plurality of fasteners 44, one for each of the lateral flanges is provided. Typically these fasteners are wood screws or the like. In the assembly, the latch member 14 is retained by the mounting surface on which the latch mechanism 10 is secured.

The latch member 14 is resiliently retained in the assembly with its forward end 34 protruding beyond the front face of the housing 12 by the compression coil spring which is retained in the cavity 18. As previously mentioned, the coiled spring projects from the cavity into the rectangularly shaped slot of the latch member.

As shown in FIG. 4, the latch member is extended, compressing the coil spring. This extension occurs when the master drawer is closed, and the end of the drawer meets the rear end of the latch member 14, causing it to resiliently extend.

Referring now to FIG. 5, there is illustrated the latch assembly of latch mechanism 10, a riser member 46 and a plurality of stop members 48. The elements are illustrated in the positions that they would occupy when installed in an item of furniture. The furniture has a vertical partition 63 which is located between the master drawer 65 and a laterally located vertical stack of drawers, the lowermost one of which is shown as drawer 67 in phantom lines. In such an arrangement, the latch mechanism 10 would be installed on the master drawer side of partition 63, and is therefore shown in hidden object lines. The forward end of the latch member 14 projects towards and adjacent to the upper post 50 of the riser member 46. The slide member 46 is mounted in a groove 61 on the lateral drawers side of the partition 61. It is slidably received in the groove 61 so that it can be displaced vertically. A short vertical slot 57 is cut in the groove 61 through the partition 63, and post 50 extends through this groove. The riser member 46 can be formed of metal or plastics; preferably a commercially available member is employed which comprises a steel bar having a plurality of posts secured thereto, preferably mounted with adjust means to position them at varied locations along the riser member. The riser member 46 is provided with a plurality of lock posts 49 which are located at pre-selected positions along its length, so as to be adjacent to each of a plurality of vertically stacked drawers.

A like plurality of stop members 48 are provided, one for each of the plurality of posts 49 of the riser member 46. In the illustration, three stop members 48 are positioned adjacent to three stop posts 49 of the riser member 46. These stop members are angle members, each having a base 54 and an orthogonally oriented leg 56 which can be reinforced by a suitable web 58. The base 54 is provided with two apertures 60 and 62 for receiving fasteners which secure the stop members 48 to the sides of the drawers. Preferably one of the apertures, e.g., 62, is elongated so as to provide slidable adjustability of the position of the stop members along the sides of the drawers.

The latch housing 12, the latch member 14 and the stop members 48 are preferably injection molded of a suitable plastic such as polyvinylchloride, polypropylene, acrylonitrile-butadiene-styrene, acrylics, etc. These members could also be cast of thermoset plastics such as phenolformaldehyde, or metals such as aluminum.

As shown in FIG. 5, the lock mechanism is disengaged, with the master drawer 65 opened to permit the compression spring to retract the latch member 14 to its position shown in FIG. 3. In this position, the riser member 46 is released and will move downwardly to the illustrated position wherein the stop posts 49 are outside of the horizontal travel of the stop members 48. In this position, the lateral drawers are free to open and close, with the stop members moving along the horizontal arrowheaded lines.

Figure 6:
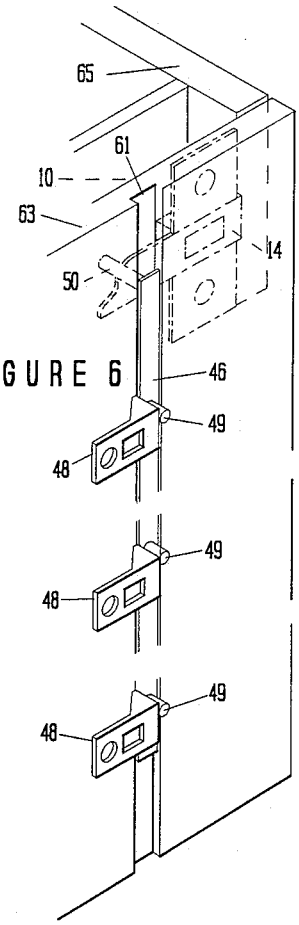
FIG. 6 illustrates the latch of FIG. 5 in the locked position.

The latch is shown in its locking position in FIG. 6. The master drawer 65 has been closed, extending the latch member 14 to its position shown in FIG. 4 where the forward end of the latch member 14 engages the locking post 50 which is lifted along the inclined ramp forward end of the latch member, raising the riser member 46 vertically. In this position, the lock posts 48 are directly opposite each of the stop members 49. The stop members 48 cannot be moved past posts 49, and the plurality of vertically stacked drawers to which these stop members are attached are thereby locked in the furniture.

The invention provides a latch mechanism of low-cost which is capable of mass production using injection molding techniques. The latch member 14 is entirely reversible, end-to-end and top-to-bottom in the housing. This permits it to be adapted to every possible furniture configuration while using only two members. Additionally, the stop members 48 are readily reversible and of a single design which can be used in all applications. The latch mechanism provides a resilient mounting of the latch member which readily deflects when the master drawer is closed and which resilient returns to a retracted position when the master drawer is opened. This resilient mounting is achieved with the addition of only a single member, i.e., the compression coil spring, and the provision of a spring cavity in the latch housing and an aligned slot in the latch member. Thus, a minimum number of parts are required for the latch mechanism. None of the parts requires any finishing or machining, and all of the members are injection molded so that the entire mechanism can be provided at very low cost and of single, uniform dimensions thereby permitting rapid and simple installation.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A reversible latch mechanism comprising:

a. a single-piece housing formed as a rectangular block having end walls and longitudinal side walls and having a spring retaining cavity formed centrally on one of the longitudinal side walls, said one longitudinal side wall including a pair of raised lip portions on opposite longitudinal edges thereof, and a pair of flanges extending outwardly from the opposite raised lipped portions, each flange having at least one aperture for receiving a mounting fastener;

b. a flat plate latch member slidably received between said raised lip portions and having an elongated aperture with a size coextensive the width and length of said cavity and aligned therewith;

c. a compression spring received in said spring retaining cavity and extending radially into said elongated aperture of said latch member, whereby said latch member is resiliently biased into alignment with said spring cavity; and d. an inclined ramp guide on at least one end of said latch member.

2. The latch mechanism of claim 1 wherein said housing is integral with said pair of flanges.

3. The latch mechanism of claim 1 wherein said housing and said latch member are formed of plastics.

4. The latch mechanism of claim 3 wherein said housing and latch member are formed of injected molded plastics.

5. A kit for assembly into a latch for locking drawers of furniture comprising:

a. a reversible latch mechanism including:

(i) a single-piece housing formed as a rectangular block having end walls and longitudinal side walls and having a spring retaining cavity formed centrally on one of the longitudinal side walls, said one longitudinal side wall including a pair of raised lip portions on opposite longitudinal edges thereof, and a pair of flanges extending outwardly from the opposite raised lipped portions, each flange having at least one aperture for receiving a mounting fastener;

(ii) a flat plate latch member slidably received between said raised lip portions and having an elongated aperture with a size coextensive the width and length of said cavity and aligned therewith;

(iii) a compression spring received in said spring retaining cavity and extending radially into said elongated aperture of said latch member, whereby said latch member is resiliently biased into alignment with said spring cavity;

(iv) an inclined ramp guide on at least one end of said latch member;

b. a riser strip in the form of an elongated bar with a transversely dependent post at its upper end and in contact with said inclined ramp guide; and c. at least one additional post secured to said bar beneath said dependent post, and including at least one stop angle member having a base with an orthogonal arm and with mounting apertures in its base to receive mounting fasteners.

6. The kit of claim 5 including a plurality of additional posts each positioned at a predetermined spaced apart location from the next adjacent post on said elongated bar and a like plurality of said stop members, on of said stop members positioned adjacent to each of said plurality of posts.

7. The kit of claim 6 wherein each of said stop members is formed of injected molded plastics.

8. An item of furniture including the kit of claim 7 wherein said item of furniture has a vertical partition with drawers positioned on opposite sides thereof, and including a vertical groove on one side of said partition with said riser strip slidably received in said vertical groove, an elongated through slot extending through said partition adjacent the upper end of said vertical groove, with said dependent post received in said through slot and extending through said partition, and wherein said latch mechanism is mounted on the side of said partition opposite said one side, with the inclined ramp end of said latch mechanism adjacent said top post whereby said latch mechanism engages and raises said top post when said latch mechanism is moved towards said post.

9. The item of furniture of claim 8 wherein the drawers positioned to the one side of said partition are mounted in a vertical array and each of said drawers has one of said stop members mounted on its outside side at a location adjacent to a respective one of said additional posts and aligned therewith when said top post is raised upwardly by the inclined ramp end of said latch member.

* * * * *